United States Patent [19]

Balbo

[11] Patent Number: 4,902,001

[45] Date of Patent: Feb. 20, 1990

[54] CYCLE EXERCISER

[76] Inventor: Joseph Balbo, 2450 E. Sprague Rd., Broadview Heights, Ohio 44147

[21] Appl. No.: 114,856

[22] Filed: Oct. 30, 1987

[51] Int. Cl.[4] ..... A63B 21/00

[52] U.S. Cl. ..... 272/73; 74/48

[58] Field of Search ..... 272/71, 72, 73, 97, 272/116, 131, 132, 134, 128; 74/47, 48, 571; 128/25 R

[56] References Cited

U.S. PATENT DOCUMENTS

| | | | |
|---|---|---|---|
| 326,247 | 9/1885 | Root | 272/73 |
| 2,261,355 | 11/1941 | Flynn | 128/25 R |
| 3,605,288 | 9/1971 | Smolka | 272/97 |
| 4,188,030 | 2/1980 | Hooper | 272/73 |
| 4,657,244 | 4/1987 | Ross | 272/73 |
| 4,712,789 | 12/1987 | Brilando | 272/73 |
| 4,712,790 | 12/1987 | Szymski | 272/73 |

FOREIGN PATENT DOCUMENTS

| | | | |
|---|---|---|---|
| 0517774 | 2/1931 | Fed. Rep. of Germany | 272/73 |
| 3517461 | 5/1986 | Fed. Rep. of Germany | 272/73 |

*Primary Examiner*—Stephen R. Crow

*Attorney, Agent, or Firm*—Fay, Sharpe, Beall, Fagan, Minnich & McKee

[57] ABSTRACT

This invention relates to cycle exercisers and is particularly applicable to such exercisers that either alternatively or simultaneously exercise the muscles of the legs and lower torso and muscles of the arms and upper torso. Arm levers for propelling the energy absorbing wheel of a cycle exerciser, do so by acting on crank arms through rotating slidable bearing means operating in slots in the arm levers; the crank arms are connected to a second drive shaft that is linked to the wheel by chain drive means.

11 Claims, 3 Drawing Sheets

FIG. 2
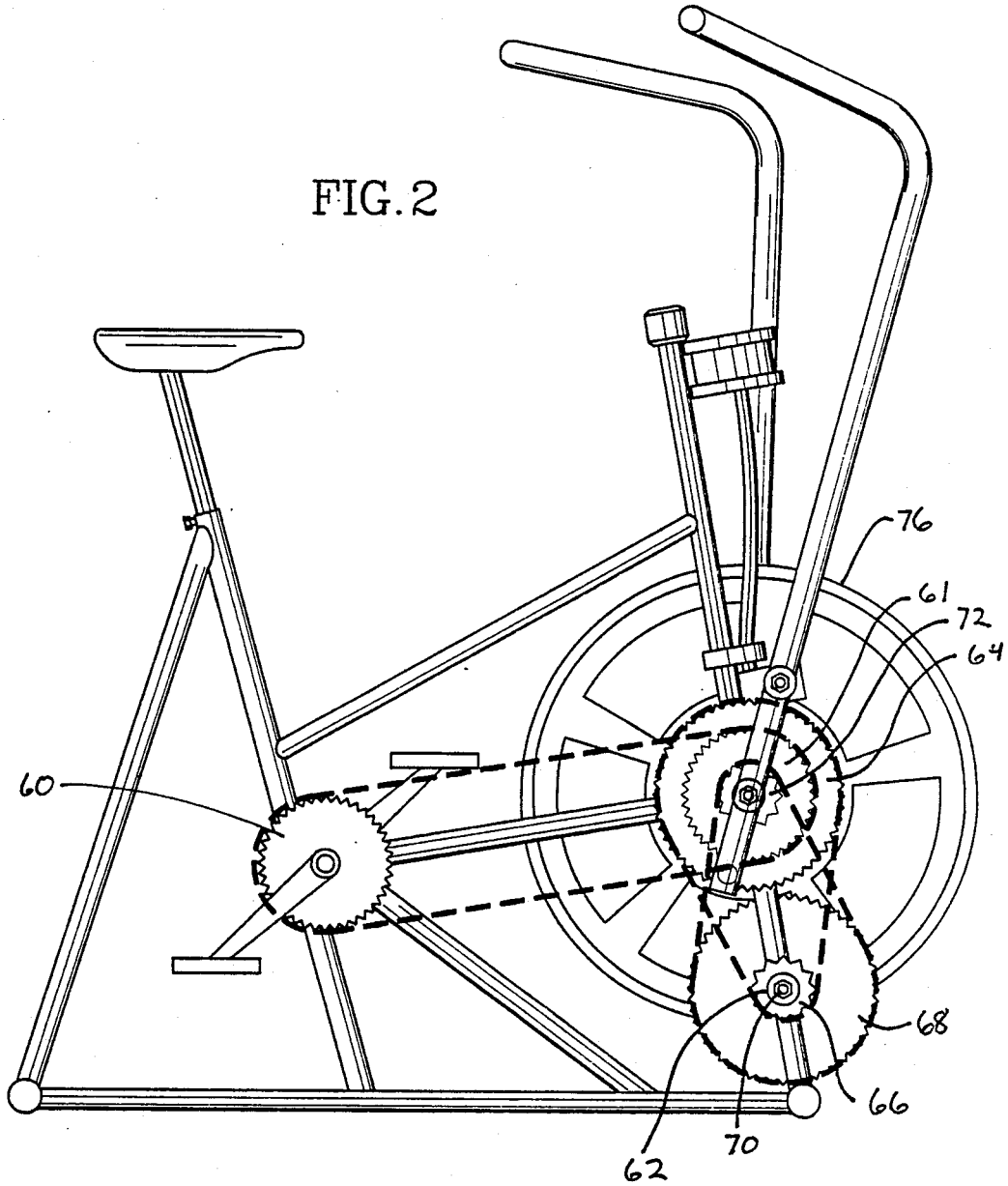
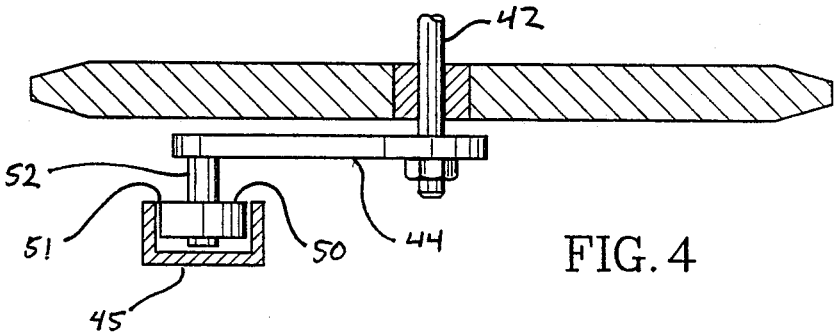
FIG. 4

CYCLE EXERCISER

INTRODUCTION

This invention relates to cycle exercisers and is particularly applicable to such exercisers that either alternatively or simultaneously exercise the muscles of the legs and lower torso and muscles of the arms and upper torso.

Normal cycle exercisers suffer a disadvantage in that they only make use of the muscles of the legs and lower torso of the user. They do, of course, impose a modest desirable added burden on the circulatory system and the oxygen transport system of the body. Present emphasis on exercises of a more active nature such as jogging or aerobic exercises are intended to increase the burden on those body systems while exercising a greater variety of muscle groups.

Cycle exercisers have been developed that offer the user exercise of the upper torso in a rowing motion and even a motion that combines rowing with a twisting of the torso by requiring one's arms to reach to different distances; the basic motion of these exercisers is that of rowing and most of them require no significant effort by the upper muscles, the motion of these upper muscles being driven by the action of the leg muscles through the exercise equipment.

More recently, two cycle exercisers have been developed wherein an energy absorbing wheel is driven, either alternatively or simultaneously by the legs and the arms acting through the exercise machine. As these exercisers are driven by the arms, the arms act in alternating fashion (as in a swimming motion) rather than in simultaneous fashion, as in the aforementioned rowing motion. The intent is clearly to offer a greater degree of exercise to the muscle groups of the upper body and to do so in a manner that can be used to drive an energy absorbing wheel using the arm motion alone, without leg motion. These exercisers suffer from certain disadvantages relating to their basic design. These disadvantages are overcome in the present invention.

U.S. Pat. No. 4,188,030, by Hooper, teaches the use of a mechanical link between each handle bar and an eccentric on the pedal shaft to create alternating motion of the separate handle bars in a swimming motion and provides that the handle bars may be used to drive the energy absorbing wheel, with or without the use of the leg muscles. A positive feature of this invention is that the motions of the handle bars are synchronized with the motions of the pedals. A disadvantage is that there is no way to stop pedaling and rest the feet on the pedals while driving the energy absorbing wheel by means of the handlebars.

U.S. Pat. No. 4,657,244, by Ross, teaches another approach to linking the handlebars to the energy absorbing wheel, this time by means of gears associated with only the wheel, which wheel is simultaneously or alternatively driven by chains and sprockets linking it to a standard pedal crank. A significant disadvantage seen in the Ross exerciser is the lack of synchronized action of the arms and the legs, especially in embodiments wherein a one-way clutch is employed to provide for resting either the hands or the feet on their respective drive elements while continuing to operate the exerciser by using the non-resting pair of extremities. In such instances, even if chain sprocket and gear ratios provide for synchronization, the one-way clutch may easily disrupt such synchronization.

This invention affords another type of cycle exerciser that can provide exercise for both the lower and upper part of the body, but which differs from other such exercisers in that it uses a different system for mounting the arm levers and for linking them to the driven wheel.

SUMMARY OF THE INVENTION

In its simplest embodiment, the cycle exerciser of this invention is constructed in the manner of a conventional cycle exerciser with a frame, a seat, foot pedals, a principal chain drive system, and an energy absorbing flywheel. Additionally, extending outward from the axle of the flywheel on one side thereof is a first sprocket for engagement by a drive chain, which sprocket rotates with the flywheel. A second sprocket fixedly attached to a second drive shaft rotatably carried by the frame is positioned so as to align with the first sprocket and a drive chain links these two sprockets. Eccentric means on each end of said second drive shaft engage a pivot means that in turn engages a reciprocating arm. Movement of the reciprocating arms by the user will cause rotation of the second drive shaft, causing the attached second sprocket to drive the first sprocket and, consequently, to drive the flywheel. Thus the wheel of this cycle exerciser may be driven by the arms of the user as well as by his legs, thereby providing exercise for the upper part of the body as well as the lower part of the body.

In a more advanced embodiment of this invention, a jackshaft is interposed between the flywheel and the principal chain drive system to increase the rotational speed of the flywheel and means are provided for the pedals and reciprocating arms to apply rotational forces that are synchronized. In the best mode of this embodiment, the jackshaft drive train includes a free-wheeling clutch capable of delivering torque to the flywheel, but incapable of having the flywheel deliver torque to the drive system (i.e., pedals and arms), thereby to allow the user to abruptly stop exercising without the flywheel causing the pedals and reciprocating arms to continue their motion.

BRIEF DESCRIPTION OF THE DRAWINGS

FIG. 2 is a right-side elevational view of a front-wheel cycle exerciser built to include the present invention in its preferred mode.

FIG. 4 is a cross sectional view showing the interconnection between crank arms and arm levers of the present invention.

DETAILED DESCRIPTION OF THE INVENTION

The reciprocating arm levers and second drive shaft construction of this invention can be attached to any conventional cycle exerciser. Even modified cycle exercisers, wherein the flywheel is mounted other than in front of the user could be adapted to include the reciprocating arm levers construction of this invention. For purposes of simplicity, the instant invention will be described in conjunction with the features of a typical front-wheeled cycle exerciser.

Figure 1:
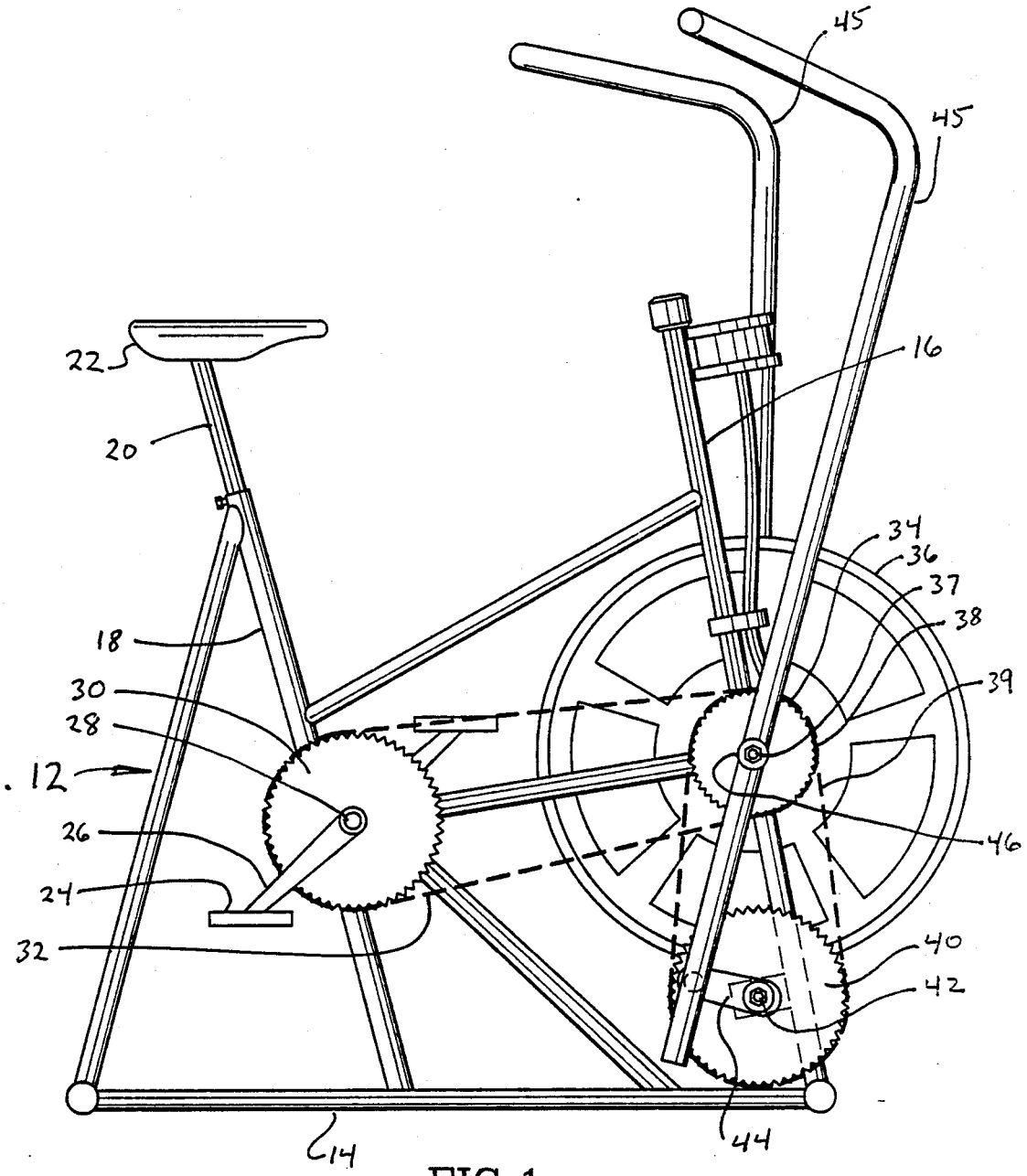
FIG. 1 is a right-side elevational view of a front-wheel cycle exerciser modified to include the present invention.

A typical cycle exerciser, as is shown in FIG. 1, wherein such an exerciser has been modified to include the present invention, includes a frame 12, comprising a base 14, a front support 16, a rear support 18, a seat support 20, and the seat 22. The frame 12 may be made of tubes, as shown in FIG. 1, or it may be made of plates or other structures that will provide a solid support for the cycle exerciser. The frame 12 is preferably made of metal, but other materials may also be suitable. Any conventional bicycle seat may be used on a cycle exerciser.

The typical cycle exerciser also includes right and left foot pedals 24, each mounted on a crank arm 26 attached to a main drive shaft 28 upon which is mounted a primary sprocket 30. Alternating force by the user of the cycle exerciser on the right and then the left foot pedals causes rotation of the main drive shaft 28 and the primary sprocket 30. A continuous chain loop 32 is passed over the primary sprocket 30 at one end and a secondary sprocket 34 at the other end, which secondary sprocket is usually directly attached to an energy absorbing flywheel 36. Thus, in the typical cycle exerciser, the effort expended upon cranking the pedals 24 is transmitted by the primary sprocket 30 to the drive chain 32 and thence to the secondary sprocket 34 and the flywheel 36 where it is dissipated in some controlled fashion. I refer to this chain drive train as the principal chain drive system. Any of the conventional other systems that are currently in use for cycle exercisers may also be used to link the pedals 24 to the flywheel 36. In most instances it is desirable to place chainguards (not shown) over the drive chains to prevent contact of the sprockets or chain with the body or the clothing, thereby to keep the body and the clothing from becoming soiled or injured as a result of such contact.

Flywheels or energy absorbing wheels of many types are used on various typical cycle exercisers, including those using air resistance as in Hooper, braking devices as in Lee (U.S. Pat. No. 4,235,436), or roller devices as in another patent that was issued to Lee (U.S. Pat. No. 4,206,914). No attempt is made here to illustrate or describe the details of an energy absorbing wheel, and no limitation thereon should be inferred from the drawings attached hereto.

"Speedometers", ergometers, "odometers", clocks, timers, or other instrumentation are often added to the typical cycle exerciser to provide information to the user to gage his energy output or the duration of his exercise. The instant invention does not preclude the use of any of the aforementioned features of the typical cycle exerciser, although the features may take on a modified form to be functional when the reciprocating arm levers of the instant invention are added.

A significant feature of the present invention is that the energy absorbing wheel 36 need not be in front of the user, although the arm levers that may be used to drive the wheel are definitely in front of the user. The energy absorbing wheel 36 may even be absent and replaced by another energy absorbing device, such as a pump or a dynamo, for examples, and these may be mounted wherever is convenient for mounting, as long as they may be linked by drive chain to both the primary sprocket 30 associated with the pedals and to the sprocket later described as being associated with the handle bars. This feature becomes a decided advantage in situations where alternate energy absorbing means are employed. For purposes of simplicity, however, I shall confine my description to a cycle exerciser having a front-mounted energy absorbing wheel.

The simplest embodiment of the present invention could be adapted for use on a standard cycle exerciser, resulting in what I shall call a modified cycle exerciser as shown in FIG. 1. In this modified cycle exerciser, the front wheel 36, being driven by the customary principal chain drive system, rotates on an axle 37 whose distal end portions extend out of the right and left sides of the front wheel 36. On at least one of the end portions of this axle is mounted a sprocket 38 that turns as the wheel 36 and the secondary drive sprocket 34 turn. Over this additional first sprocket 38 a continuous chain 39 is passed that also engages a second sprocket 40 on a substantially horizontal second drive shaft 42 having two ends thereof rotatably secured to the frame 12. A crank arm 44 is secured to each of two opposite end portions of this second drive shaft, the two crank arms extending laterally from the drive shaft 42 in opposite directions. As will be further described below, this second drive shaft is to be linked to reciprocating arm levers 45 for exercising muscle groups in the upper torso and the arms. In this modified cycle exerciser, the sprocket tooth ratio of this first and second sprocket set is exactly the inverse of the sprocket tooth ratio of the principal chain drive system that transmits energy from the pedal system to the wheel; thus the second drive shaft 42 turns in exact synchrony with the primary drive shaft 28 to which the pedals are connected, thereby coordinating arm and leg motions, which motions are generally desired to be in a predetermined phase relationship during exercising both upper torso and lower torso muscle groups.

In this modified cycle exerciser, separate left and right reciprocating arm levers 45 are pivotally attached on each respective side of the frame 12 in front of the user, as at 46. This pivotal attachment is generally made above the aforementioned second drive shaft 42 and a length of each lever extends below the point of attachment and is slotted as shown in detail in FIG. 4 to receive a rotational bearing means 50 that will slide lengthwise in the slot 51 while being retained therein. Alternatively, the pivotal attachment may be made below the second drive shaft and a length of each lever proximal the cyclical path of the end of said crank arm is slotted lengthwise to receive the bearing means. Referring again to FIG. 4, from the end of each crank arm 44 associated with the second drive shaft 42 there protrudes a pin 52 or bearing stud, fixedly attached to the crank arm, and upon which pin the said rotational bearing means 50 is mounted. This bearing means is slidably engaged with the slot 51 in the corresponding reciprocating arm lever 45, thereby linking the pin and the arm lever in sliding and rotational contact.

As this modified cycle exerciser is pedaled by the user, the pedals turn the principal drive chain 32 system that turns the wheel 36; the turning of the wheel causes the first sprocket 38 to drive, by means of the chain linking them, the second sprocket 40 and second drive shaft 42 at the same rotational velocity (speed and direction) as the primary sprocket 30 and first drive shaft 28 driven by the pedals; the protruding pin 52 fixedly attached to the crank arm 44 of the second drive shaft 42 causes a reciprocating motion of the arm levers 45 through said rotational bearing means 50, which motion is in synchrony with the pedal motion. Alternatively, the user may operate the arm levers 45 in reciprocating fashion, thereby driving the second drive shaft 42, the second sprocket 40 and thus the first sprocket 38 and the flywheel 36. A one-way clutch may be included in the principal chain drive system to allow the user to stop pedaling while driving the wheel using the arm levers, but the clutch should be of a type that would ensure the desired synchronization of the revolving of the pedals and the reciprocating of the arm levers. A clutch mechanism could alternatively be interposed between the flywheel 36 and both the principal chain drive system and the chain drive associated with the arm levers 45, thereby allowing pedaling and arm motions to both be stopped while the flywheel continues to turn. A variety of such arrangements could be made to provide for immediate stopping of either pedaling or arm motions or both pedaling and arm motions without waiting for the energy stored in the flywheel to be dissipated. Means for such clutches have long been available. This concludes my discussion of a cycle exerciser modified according to my teachings of the present invention.

Figure 3:
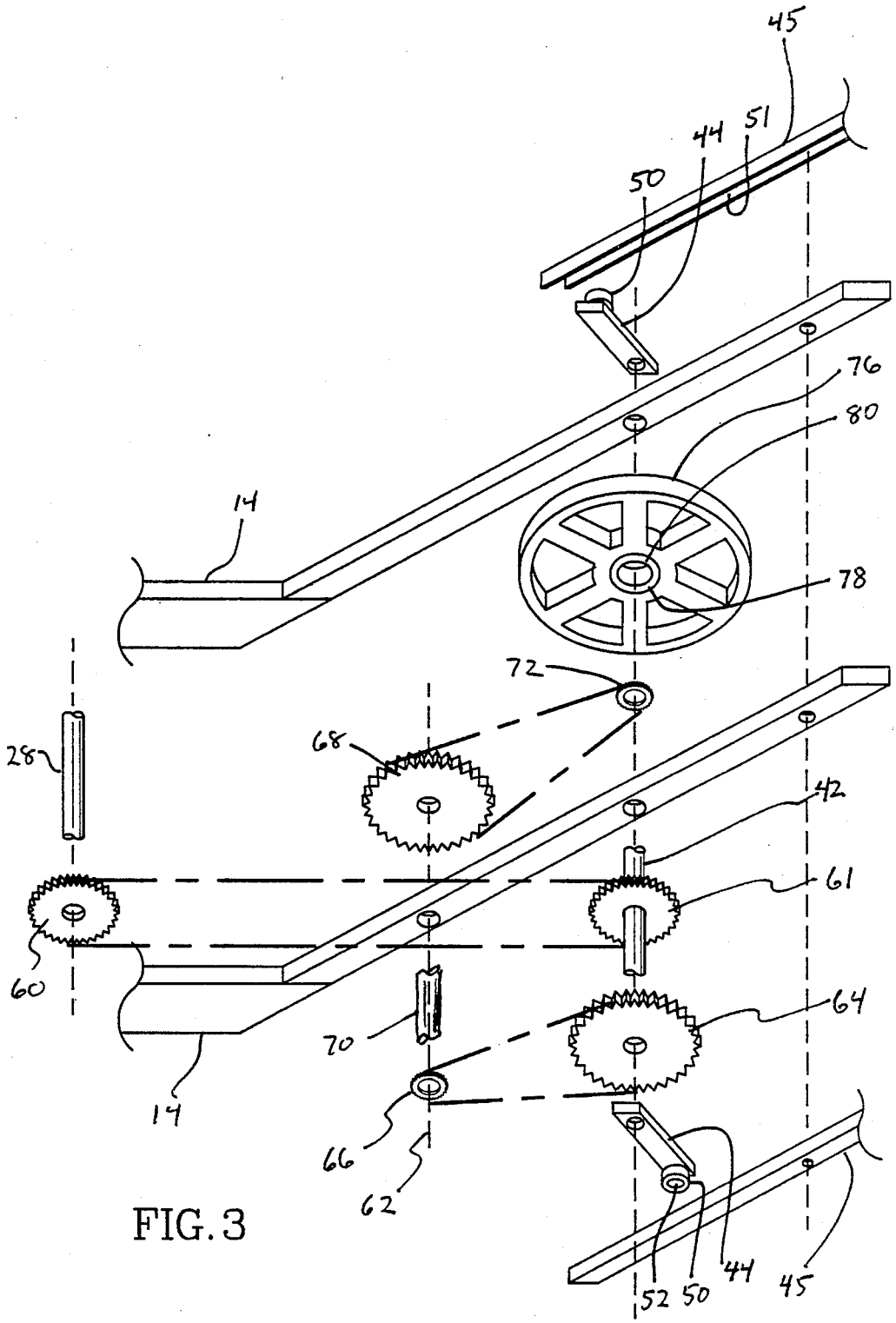
FIG. 3 is an exploded view of the two drive shafts of the present invention and their associated drive means in the preferred mode.

In a preferred embodiment of the present invention, illustrated in FIGS. 2, 3, and 4, the primary 60 and secondary 61 sprockets of the principal chain drive system are equal in diameter and tooth count, therefore they always turn in synchrony. A jackshaft 62 is driven by a second sprocket 64 connected to and therefore turning with either the primary sprocket 60 or the secondary sprocket 61 of the principal chain drive system. The jackshaft 62 comprises a first jackshaft sprocket 66 somewhat smaller than the said second sprocket 64 (that turns with the sprockets of the principal chain drive system) and a second jackshaft sprocket 68 somewhat larger than the first jackshaft sprocket and mounted on a common axle 70 therewith. The second jackshaft sprocket 68, which turns with the first jackshaft sprocket 66, is linked by a drive chain to a sprocket 72 attached to and turning with the flywheel 76. Generally this flywheel sprocket 72 is smaller than the second jackshaft sprocket 68. Thus, one skilled in the art would recognize that the jackshaft arrangement herein described causes the flywheel 76 to turn at a speed greater than that of the primary sprocket 60 of the principal chain drive system. In this embodiment, a one-way clutch mechanism could be incorporated on the jackshaft axle 70 or on the axle of the flywheel 78. This one-way clutch mechanism would allow the user of the cycle exerciser to immediately stop pedaling while the flywheel continues to turn as the rotational energy stored therein is dissipated. Such a clutch could be incorporated in the principal drive train, in the drive train associated with the reciprocating arm levers, or one in each of these drive trains.

In this preferred embodiment, as illustrated in FIGS. 2, 3, and 4, the reciprocating arm levers 45 are linked to the secondary sprocket 61 by means of a pair of crank arms 44 attached to the axle of the secondary sprocket 61 (via the second drive shaft 42), one on each side of the front upright supports, which crank arms are similar to the pedal crank arms except that in place of each pedal on the crank arm, there protrudes a pin 52, or bearing stud, fixedly attached to the crank arm 44, and upon which pin the said rotational bearing means 50 is mounted. This bearing means is slidably engaged with the slot 51 in the corresponding reciprocating arm lever 45, thereby linking the pin and the arm lever in sliding and rotational contact.

It should be clear from this description that, although the reciprocating arm levers 45, the secondary sprocket 34 of the principal chain drive system, and its associated crank arms 44 must all be positioned in front of the user to allow the arm levers to be in convenient position for operation by the user, there is no requirement for the jackshaft 62 and the flywheel 76 to be in any specific location. Indeed, a pump or a dynamo might be the energy absorbing means associated with the exerciser of this invention and the flywheel may be a part of such ancillary equipment.

In the best mode, however, it is convenient to place the flywheel 76 before the user of the cycle exerciser, where it is on a common axis with the secondary sprocket 61 of the principal chain drive system and its associated crank arm 44 linking it to the arm levers 45. In this embodiment, the flywheel 76, although coaxial with other operating members, is turning at a higher speed that the others. This is accomplished by providing bearings 80 to isolate the drive shaft 42 of the crankarm assembly from the hollow axle of the faster-rotating flywheel 36, through which hollow the crankarm drive shaft extends.

Now, having described my invention in detail sufficient that one skilled in the art could duplicate the mechanism and reproduce my results, and having included detail applicable to specific non-limiting examples, I request protection under letters patent for my invention as limited only by the scope of the claims hereto appended.

I claim:

1. A cycle exerciser including:

a frame;

a seat mounted on said frame;

rotational energy absorbing means mounted on said frame;

a substantially horizontal first drive shaft having two ends rotatably carried by said frame;

first drive means connecting said first drive shaft to said energy absorbing means to cause rotation thereof in response to rotation of said first drive shaft;

a first pair of drive crank arms each secured to opposite end portions of said first drive shaft and extending laterally therefrom in opposite directions;

two foot pedal arms;

connecting means through which each said foot pedal arm is fixedly secured to the outer end of a respective said first drive crank arm to permit rotation of said drive shaft by foot operation;

a substantially horizontal second drive shaft having two ends rotatably carried by said frame;

a second pair of crank arms each secured to opposite end portions of said second drive shaft and extending laterally therefrom in opposite directions;

second drive means connecting said second drive shaft to said energy absorbing means to cause rotation thereof in response to rotation of said second drive shaft;

a portion of said first drive means being common to a portion of said second drive means, that portion not being common to the said two drive means comprising a synchronous drive means operatively engaging said first drive shaft with said second drive shaft, which said synchronous drive means causes said two drive shafts to turn synchronously;

two handlebar arm levers pivotally mounted on said frame for oscillating movement about a mounting pivot thereof;

and means rotatably and slidably attaching each said arm lever to each respective said second drive crank arm to permit rotation of said energy absorbing means by hand operation of said arm levers.

2. The cycle exerciser of claim 1 wherein said first and second drive means maintain a constant rotational phase relationship between said first and second drive shafts, thereby to maintain a constant phase relationship between said foot pedals and said arm levers.

3. The cycle exerciser of claim 1 wherein said means rotatably and slidably attaching each said arm lever to respective second drive crank arms comprises a horizontal pin fixedly secured to the outer end of a respective second drive crank arm, and a bearing means mounted on said horizontal pin and slidably engaging a lengthwise slot in said arm levers.

4. The cycle exerciser of claim 1 wherein said first drive means connecting said first drive shaft to said energy absorbing means and said second drive means connecting said second drive shaft to said energy absorbing means both comprise non-slipping drives having exactly the same drive ratios.

5. The cycle exerciser of claim 1 wherein the common portion of said first and second drive means comprises a jackshaft to alter the rotational speed of said energy absorbing means relative to the rotational speed of said first and second drive shafts, which jackshaft is mounted on the frame of the exerciser.

6. The cycle exerciser of claim 1 wherein said energy absorbing means comprises a flywheel rotatably mounted on said frame in coaxial relationship to said second drive shaft.

7. The cycle exerciser of claim 1 wherein said first drive means includes a unidirectional clutch means that allows said energy absorbing means to rotate while said first drive shaft is not rotating.

8. The cycle exerciser of claim 1 wherein said second drive means includes a unidirectional clutch means that allows said energy absorbing means to rotate while said second drive shaft is not rotating.

9. An exerciser comprising:

a frame;

an energy absorbing member operatively connected to said frame;

a first drive shaft operatively connected to said frame at an area spaced from said energy absorbing member;

first means for driving said energy absorbing member in response to rotation of said first drive shaft, said first driving means including a first sprocket rotatable with said first drive shaft, a second sprocket having the same diameter as said first sprocket and first means for transferring rotary motion of said first sprocket to said second sprocket;

a second drive shaft operatively connected to said frame at an area spaced from said first drive shaft;

second means for driving said energy absorbing member in response to rotation of said second drive shaft, said second driving means including a third sprocket, a fourth sprocket smaller than said third sprocket, second means for transferring rotary motion of said third sprocket to said fourth sprocket, a fifth sprocket larger than and rotatable with said fourth sprocket, a sixth sprocket smaller than said fifth sprocket, and third means for transferring rotary motion of said fifth sprocket to said sixth sprocket;

means for linking said first and second drive shafts and rotating said drive shafts in synchronous relation.

10. The exerciser as defined in claim 9 wherein said second driving means includes first and second arm levers secured to said fourth sprocket.

11. The exerciser as defined in claim 10 further comprising first and second crank arms interposed between respective arm levers and said fourth sprocket.

* * * * *